US005882376A

United States Patent [19]

Kim et al.

[11] Patent Number: 5,882,376

[45] Date of Patent: Mar. 16, 1999

[54] MECHANOCHEMICAL PROCESS FOR PRODUCING FINE WC/CO COMPOSITE POWDER

[75] Inventors: Byoung-Kee Kim; Gil-Geun Lee, both of Kyungsangnam-do; Gook-Hyun Ha, Pusan; Dong-Won Lee, Kyungsangnam-do, all of Rep. of Korea

[73] Assignee: Korea Institute of Machinery & Materials, Chungcheongnam-Do, Rep. of Korea

[21] Appl. No.: 910,588

[22] Filed: Jul. 25, 1997

[30] Foreign Application Priority Data

May 16, 1997 [KR] Rep. of Korea ..... 1997/19051

[51] Int. Cl.[6] ..... B22F 9/26

[52] U.S. Cl. ..... 75/352; 75/358; 75/359; 419/31; 419/32

[58] Field of Search ..... 75/351, 352, 358, 75/359; 419/31, 32

[56] References Cited

U.S. PATENT DOCUMENTS

| | | | |
|---|---|---|---|
| 5,230,729 | 7/1993 | McCaudlish et al. | 75/351 |
| 5,338,330 | 8/1994 | Polizzotti et al. | 419/31 |
| 5,352,269 | 10/1994 | McCaudlish et al. | 75/351 |

OTHER PUBLICATIONS

J. Bukowiecki et al., Catalytic Formation of Tungsten Carbide through Gas–Phase Reaction, Planseeberichte, Bd. 28 at 216–21 (1980).

B.K. Kim et al., Sintering and Microstructure of Nanophase WC/Co Hardmetals (date unknown).

II K. Ushijima, Preparation of WC–Co Powder by Direct Carburisation of WO3 in the presense of Co3 O4, Powder Metallurgy, vol. II, No. 4 (1979).

T.D. Halliday et al., Thermodynamic Considerations of the Production of Cobalt/Tungsten Carbide Mixture by Direct Gas Phase Reduction/Carburisation Reactions, Industrial Use of Thermochemical Data at 291–300 (date unknown).

*Primary Examiner*—George Wyszomierski
*Attorney, Agent, or Firm*—Schmeiser, Olsen & Watts

[57] ABSTRACT

A mechanochemical process for producing fine WC/Co composite powder which is so small in WC grain size and in mean free path, and contains such a uniform distribution of WC and Co that its hard metal is superior in strength, compressive strength, TRS and wear resistance and considerably free of impurities. The method comprises the steps of drying an ammonium metatungstate—$Co(NO_3)_2$ solution in a spray dry manner to give initial powder of porous spheroids or in a common manner to give a cake of initial powder, removing the salts and humidity from the initial powder by a thermal treatment, mixing and milling the desalted initial powder with carbon black, and subjecting the mixed powder to reduction/carburization in a reactor.

2 Claims, 3 Drawing Sheets

MECHANOCHEMICAL PROCESS FOR PRODUCING FINE WC/CO COMPOSITE POWDER

BACKGROUND OF THE INVENTION

1. Field of the Invention

The present invention relates, in general, to a mechanochemical process for producing fine tungsten carbide (WC)/cobalt (Co) composite powders.

2. Description of the Prior Art

With superior mechanical properties including wear resistance, hot strength and elasticitic modulus WC/Co hard metals are the most widely used for tool materials or wear-resistant parts.

Such mechanical properties of the hard metal generally depend on its chemical composition, the grain size distribution of WC, its carbon content and micro structure, and the defects it contains, such as pore, free carbons and impurities. Of them the size of WC grain and the mean free path of WC and Co are the most important variables to determine the properties of the hard metal. For example, as the WC grains in the hard metal become smaller, hardness, compressive strength, transverse rupture strength (TRS) and wear resistances are improved. In addition, the smaller the mean free path of WC and Co is, the better the mechanical properties of the hard metal. Thus, in order to improve the properties of WC/Co hard metal, it is necessary to make the size of WC grain smaller and the mixture of Co and WC more homogeneous.

Conventionally, WC/Co composite powder is prepared by sufficiently mixing tungsten (W) with carbon black in a ball-mill, and performing a heat treatment for the mixture at 1,400°–1,600° C. in a carbon crucible under a hydrogen atmosphere to give WC, and mixing it with Co, serving as a binder with a ball-milling. However, the ball-milling may cause detrimental impurities to be contained in the resulting powder and the strongest pulverization possible may have a limited effect in making the powder fine. Moreover, it is virtually impossible to completely mix W with carbon or WC with Co owing to the difference in their specific gravities. It is also difficult to make fine WC grain with Co by ball milling. Further, since a temperature as high as 1,400° C. is required for the carbonizing reaction, the conventional method has disadvantages in the production costs when considering the facility necessary for such high temperatures and the energy consumed.

SUMMARY OF THE INVENTION

It is, therefore, an object of the present invention to overcome the above problems encountered in the prior art and to provide a mechanochemical process for producing fine WC/Co composite powders of small WC grain size and the mean free path and of uniform WC and Co distridution of which the hard metal is superior in strength, compressive strength, tranverse rupture strength (TRS), wear resistance and considerably free of impurities.

It is another object of the present invention to provide an economically favorable mechanochemical process for producing fine WC/Co composite powder, whereby a considerable improvement in the mechanical properties can be achieved through the complete intermingling of the components.

In accordance with the present invention, the above objects could be accomplished by a provision of a mechanochemical process for producing fine WC/Co composite powder, comprising the steps of drying an ammonium metatungstate—$Co(NO_3)_2$ solution in a spray dry manner to give initial powder of spheroids or in a similar manner to give a cake of initial powder, removing the salts from the initial powder by a thermal treatment, milling the desalted initial powder to mix with carbon black, and subjecting the mixed powder to reduction/carburization in a reactor.

BRIEF DESCRIPTION OF THE DRAWINGS

Other objects and aspects of the invention will become apparent from the following description of embodiments with reference to the accompanying drawings in which.

DETAILED DESCRIPTION OF THE INVENTION

Figure 1:
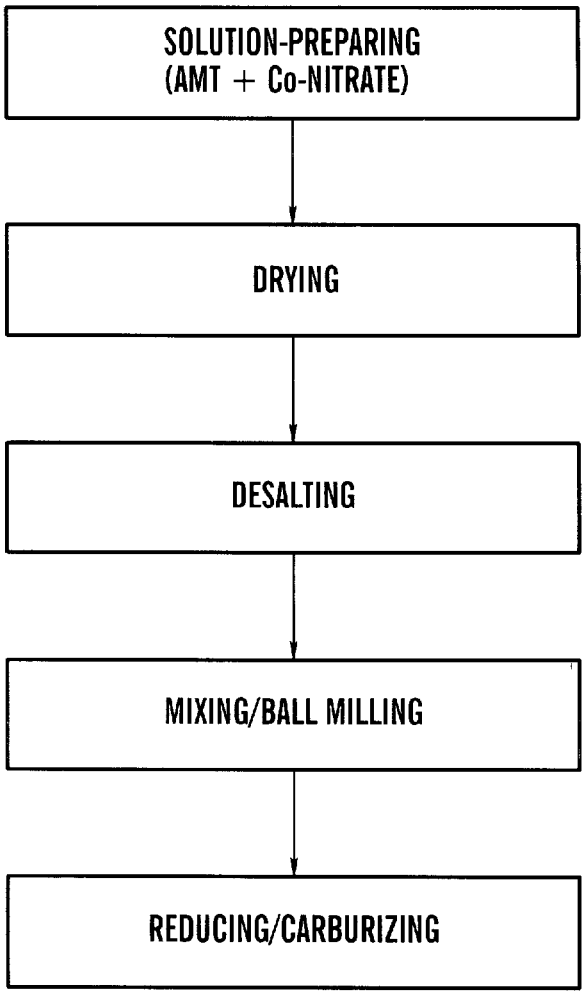
FIG. 1 is a flow chart showing the process according to the present invention.

Referring to FIG. 1, this illustrates the sequence of the process events according to the present invention.

First, ammonium metatungstate (AMT: $(NH_4)_6(H_2W_{12}O_{40}).4H_2O$) and cobalt nitrate ($Co(NO_3)_2.6H_2O$) are weighed at appropriate amounts and dissolved in water. This aqueous solution is subjected to a drying step to give an initial powder. For this, a spray drier may be employed which is operated at an air-intake temperature of 250° C. and an exhaust temperature of 130° C. with a nozzle rotating at 11,000 rpm while the solution is fed at a rate of 40 ml per min. Alternatively, similar drying equipment which can heat up to 400° C. may be used. Following the drying step, the initial powder is desalted and dehydrated by thermally treating it at 750° C. for 2 hours under the air, to produce W/Co oxide composite powder. Subsequently, this is mechanically mixed with carbon through a ball mill in a dry manner. Finally, the W/Co oxide composite powder is subjected to reduction/carburization at 800°–950° C. in a hydrogen atmosphere under a controlled flow rate, temperature and maintenance time.

The initial powder obtained consists of globules with an average grain size of 30–40 $\mu$m which results from the homogeneous aggregation of ultra-fine powder as small as molecules.

The ball-milling step continues for 1–30 hours in the air using hard balls while the reduction/carburization step is carried out at 800°–950° C. for 1–6 hours. The WC thus obtained is about 0.1 $\mu$m in average grain size.

Now, the mechanochemical process of the invention will be in more detail described in conjunction with the drawings.

As stated above, the mechanochemical process comprises a drying step in which a homogeneous solution of W and Co salts, the starting materials, is dried or spray-dried to give an initial W/Co composite powder, a desalting step to produce W/Co oxide composite powder, a ball-milling step to blend it with carbon, and a reducing/carburizing step.

When ammonium metatungstate and cobalt nitrate are weighed, dissolved in water and dried to prepare the initial powder, a solution containing a grain growth inhibitor may be added with the aim of improving the mechanical properties of the resulting hard metal obtained.

As for the spray-drying, its reactor is preferably operated at an air-intake temperature of 250° C. and an exhaust temperature of 130° C. with a nozzle rotating at 11,000 rpm while the solution is fed at a rate of 40 ml per min.

Consisting of globules with an average grain size of 30–40 μm, the initial powder is formed by homogeneous aggregation of ultra-fine powder as small as molecules.

However, since the initial powder contains salts which have a strong affinity for moisture, the powder, if stored in the air, rapidly absorbs the moisture. Thus, it is necessary to remove the salts having a strong affinity for moisture from the initial powder and to make it an oxide.

In the present invention, the initial powder dried is thermally treated at 750° C. for 2 hours in the air to produce W/Co oxide composite powder desalted and dehydrated. As a result, the initial powder is deprived of moisture and salts, such as $NH_4$ and $NO_3$ and thus, reduced in weight by about 30% and in size by about 20%.

Figure 2A:
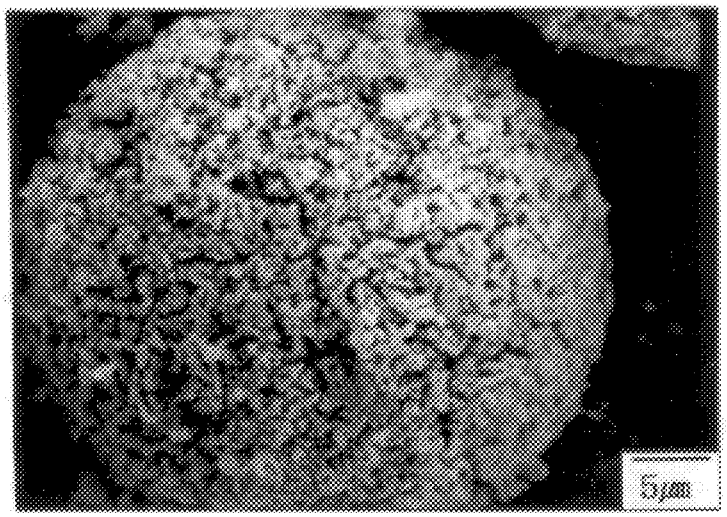
FIG. 2*a* is an electron microphotograph showing the initial powder desalted after the spray-dry, according to the present invention.

As stated above, this powder has globular composites resulting from the homogeneous aggregation of fine oxides, $WO_3$ and $Co_3O_4$, as seen in FIG. 2*a*, and it is of porosity with a large surface area.

Next, the desalted, porous W/Co oxide powder is mixed with carbon in a ball mill. During the ball-milling, the porous oxide powder grinds down at the boundary between grains and is mixed with carbon so that it infiltrates the porous W/Co oxide powder. This ball-milling process increases the internal energy of W/Co and carbon to activation, aiding to promote the carburization of the powder.

In a hydrogen atmosphere, the fine, porous $CoWO_4/WO_3/Co_3O_4$ powder mixed with carbon is reduced and carburized. When carbon is added at 2.0–2.5 folds of the stoichiometry of the W/Co powder comprising 10% by weight of Co, complete carburization can be achieved by heating at 800° C. for 1–6 hours, giving a pure stoichiometric WC/Co metal.

Figure 2B:
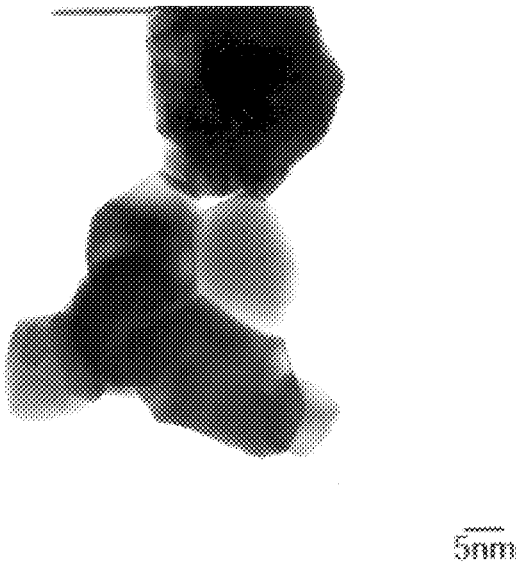
FIG. 2*b* is an electron microphotograph showing the hard metal according to the present invention.

With reference to FIG. 2*b*, the WC/Co hard metal produced by the method of the present invention is shown in an electron microphotograph. As seen, the WC/Co hard metal of the invention, about 100 nm (0.1 μm) in grain size, is much finer than conventional hard metal.

Figure 3:
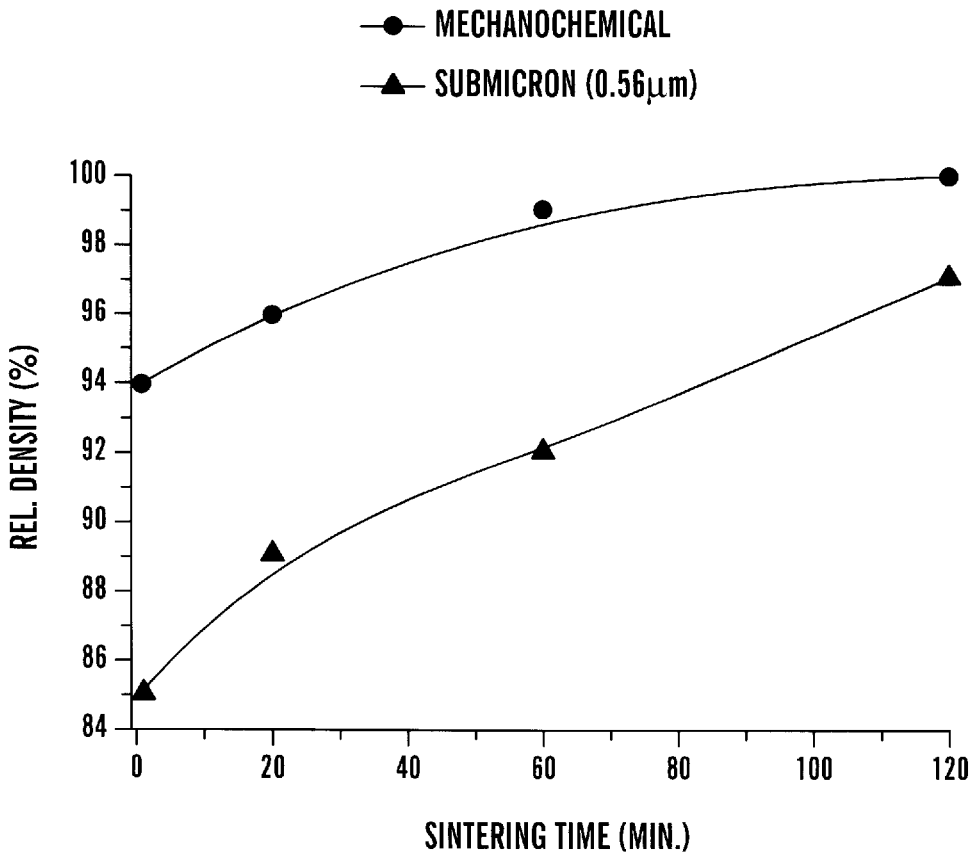
FIG. 3 is a graph showing the relative density of WC-10 wt % Co hard metal with regard to sintering time.

Turning now to FIG. 3, the relative density of the WC-10 wt % Co hard metal sintered at 1400° C. in vacuum to the theory density is shown.

For comparison, a powder molded with a mixture of WC having an average grain size of 0.56 μm and Co having an average grain size of 1.0 μm was sintered. The graph of FIG. 3 illustrates the fine hard metal produced by the mechanochemical process of the present invention is of a much higher density than common hard metal. Another datum demonstrates that the hard metal of the invention, when sintered at 1,400° C. for 1 hr, has a strength of 1,900 $kgf/mm^2$ while common hard metal has a strength of 1,650 $kgf/mm^2$.

The mechanochemical process of the invention can be applicable for all WC/Co composite metals and all hard metals comprising a base of WC/Co in combination with a grain growth inhibitor or other carbides.

As described hereinbefore, the hard metal according to the preparation process of the invention is small in WC grain size and the mean free path and uniform distribution of WC and Co, which are determinants of the mechanical properties of the hard metal, so that it is superior in strength, compressive strength, tranverse rupture strength (TRS) and wear resistance. In addition, the process of the invention can considerably exclude impurities from the hard metal. Further, it allows WC and Co to be intermingled so sufficiently that the mechanical properties of the hard metal can be improved. Moreover, the process of the present invention is economically favorable with regard to the production costs, such as manufacturing facilities and the energy consumed.

The present invention has been described in an illustrative manner, and it is to be understood that the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described.

What is claimed is:

1. A process of preparing fine WC/Co composite powder, comprising the steps of:

drying an aqueous solution containing water-soluble W salt and Co salt in a spray drier, to give initial powder;

desalting and dehumidifying the initial powder by thermally treating above 400° C. in air to give W/Co oxide composite powder;

mechanically mixing the W/Co oxide composite powder with carbon in a mill; and subjecting the milled W/Co oxide composite powder to reduction/carburization at 800°–950° C. in a hydrogen atmosphere and cooling it to a low temperature.

2. The method of claim 1, wherein the fine WC/Co composite powder contains 10% by weight Co.

* * * * *